US011242194B2

(12) United States Patent
Rogers

(10) Patent No.: US 11,242,194 B2
(45) Date of Patent: Feb. 8, 2022

(54) BICYCLE PACKAGING SYSTEM

(71) Applicant: Trek Bicycle Corporation, Waterloo, WI (US)

(72) Inventor: Kevin Rogers, Madison, WI (US)

(73) Assignee: Trek Bicycle Corporation, Waterloo, WI (US)

( * ) Notice: Subject to any disclaimer, the term of this patent is extended or adjusted under 35 U.S.C. 154(b) by 0 days.

(21) Appl. No.: 16/803,553

(22) Filed: Feb. 27, 2020

(65) Prior Publication Data

US 2021/0269230 A1 Sep. 2, 2021

(51) Int. Cl.

| | |
|---|---|
| ***B65D 85/68*** | (2006.01) |
| ***B65D 51/24*** | (2006.01) |
| ***B65D 81/133*** | (2006.01) |

(52) U.S. Cl.

CPC ..... *B65D 85/68* (2013.01); *B65D 51/248* (2013.01); *B65D 81/133* (2013.01); *B65D 2203/12* (2013.01); *B65D 2585/6862* (2013.01)

(58) Field of Classification Search

CPC .. B65D 85/68; B65D 85/6862; B65D 51/248; B65D 2203/12

USPC ..... 206/335, 736, 765, 731, 766, 774, 223, 206/319, 459.1, 459.5; 229/103.2, 122, 229/123, 124, 103.3, 127, 155, 145, 229/125.125, 129.1, 913

See application file for complete search history.

(56) References Cited

U.S. PATENT DOCUMENTS

| | | | | |
|---|---|---|---|---|
| 4,756,416 | A | 7/1988 | Johnson | |
| 5,385,293 | A * | 1/1995 | Hirota | B65D 85/68 229/122 |
| 5,669,497 | A * | 9/1997 | Evans | B65D 85/68 206/335 |
| 2009/0057387 | A1* | 3/2009 | Tirado Alanis | B65D 5/665 229/145 |
| 2018/0290820 | A1 | 10/2018 | Keiller | |

FOREIGN PATENT DOCUMENTS

| | | |
|---|---|---|
| CN | 2050412 U | 1/1990 |
| DE | 9215435 U1 | 1/1993 |
| FR | 2505301 A2 | 11/1982 |

(Continued)

OTHER PUBLICATIONS

Extended Search Report issued on EP21154016.6, dated Jun. 30, 2021.

*Primary Examiner* — Rafael A Ortiz
(74) *Attorney, Agent, or Firm* — Bell & Manning, LLC; Christopher Kalafut

(57) ABSTRACT

A packaging system for a bicycle includes a rear panel and a front panel that mates with the rear panel to form an enclosure. The front panel partially detaches from the rear panel to lay flat on a ground surface that supports the packaging system such that at least a portion of an interior side of the front panel forms a work surface that covers the ground surface. The packaging system also includes a rear insert positioned within the enclosure, wherein the rear insert includes a tire receptacle configured to receive a rear tire of the bicycle. The packaging system further includes a front insert positioned within the enclosure opposite of the rear insert, wherein the front insert includes a front fork mount attached thereto, and wherein the front fork mount is configured to secure front forks of the bicycle.

18 Claims, 15 Drawing Sheets

(56) References Cited

FOREIGN PATENT DOCUMENTS

| | | | | |
|---|---|---|---|---|
| FR | 2729123 | | 7/1996 | |
| GB | 189730742 | A | 1/1898 | |
| WO | WO-2019124516 | A1 * | 6/2019 | ..... B65D 85/68 |

* cited by examiner

BICYCLE PACKAGING SYSTEM

BACKGROUND

In part because of their health benefits, lack of pollution, and affordability, bicycles are being used more and more as a primary/secondary mode of transportation all around the world. An individual wishing to acquire a bicycle typically goes to a cycling shop and works with a salesman to determine which type, size, etc. bicycle will work best for him/her. However, there are individuals who do not have easy access to a cycling shop and/or who are too busy to go to one. Such individuals may choose to order a bicycle over the telephone or through a website, and request home delivery of the bicycle. Once such an order is processed, the bicycle is shipped to the purchaser's home, typically in packaging from the manufacturer, and typically requiring partial or complete assembly by the purchaser.

SUMMARY

An illustrative packaging system for a bicycle includes a rear panel and a front panel that mates with the rear panel to form an enclosure. The front panel partially detaches from the rear panel to lay flat on a ground surface that supports the packaging system such that at least a portion of an interior side of the front panel forms a work surface that covers the ground surface. The packaging system also includes a rear insert positioned within the enclosure, wherein the rear insert includes a tire receptacle configured to receive a rear tire of the bicycle. The packaging system further includes a front insert positioned within the enclosure opposite of the rear insert, wherein the front insert includes a front fork mount attached thereto, and wherein the front fork mount is configured to secure front forks of the bicycle.

Other principal features and advantages of the invention will become apparent to those skilled in the art upon review of the following drawings, the detailed description, and the appended claims.

BRIEF DESCRIPTION OF THE DRAWINGS

Illustrative embodiments will hereafter be described with reference to the accompanying drawings, wherein like numerals denote like elements. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Traditional bicycle packaging for home delivery is typically in the form of a box that is designed to hold a bicycle frame in an upright position. In addition to the frame, the box also includes other components of the bicycle such as the wheels, steering wheel, saddle, etc., which are to be assembled by the user upon receipt. In traditional systems, the top of the box opens and the user lifts the bicycle frame and other components out through the top of the box while the box is in the upright position. Once the bicycle components are removed from the box, the user is then able to assemble the bicycle, which can involve securing the wheels to the frame, mounting the saddle to the frame, etc.

Described herein are methods and systems for packaging bicycles that are to be directly delivered to end users. The proposed packaging systems are designed to be user friendly, and do not require the user to lift the bicycle frame or other bicycle components out the top of the box. Rather, as described in more detail below, a front of the packing system folds down onto the floor such that the user is able to remove the bicycle/components through the front of the box. The folded down front of the packaging system also acts as a work surface that provides the user with an area to assemble the bicycle, while protecting the floor from scratches, grease, etc. In at least some embodiments, the packaging system is configured to be assembled without the use of staples or adhesive. The components and functionality of the packing system are described in more detail below with reference to the figures.

Figure 1:
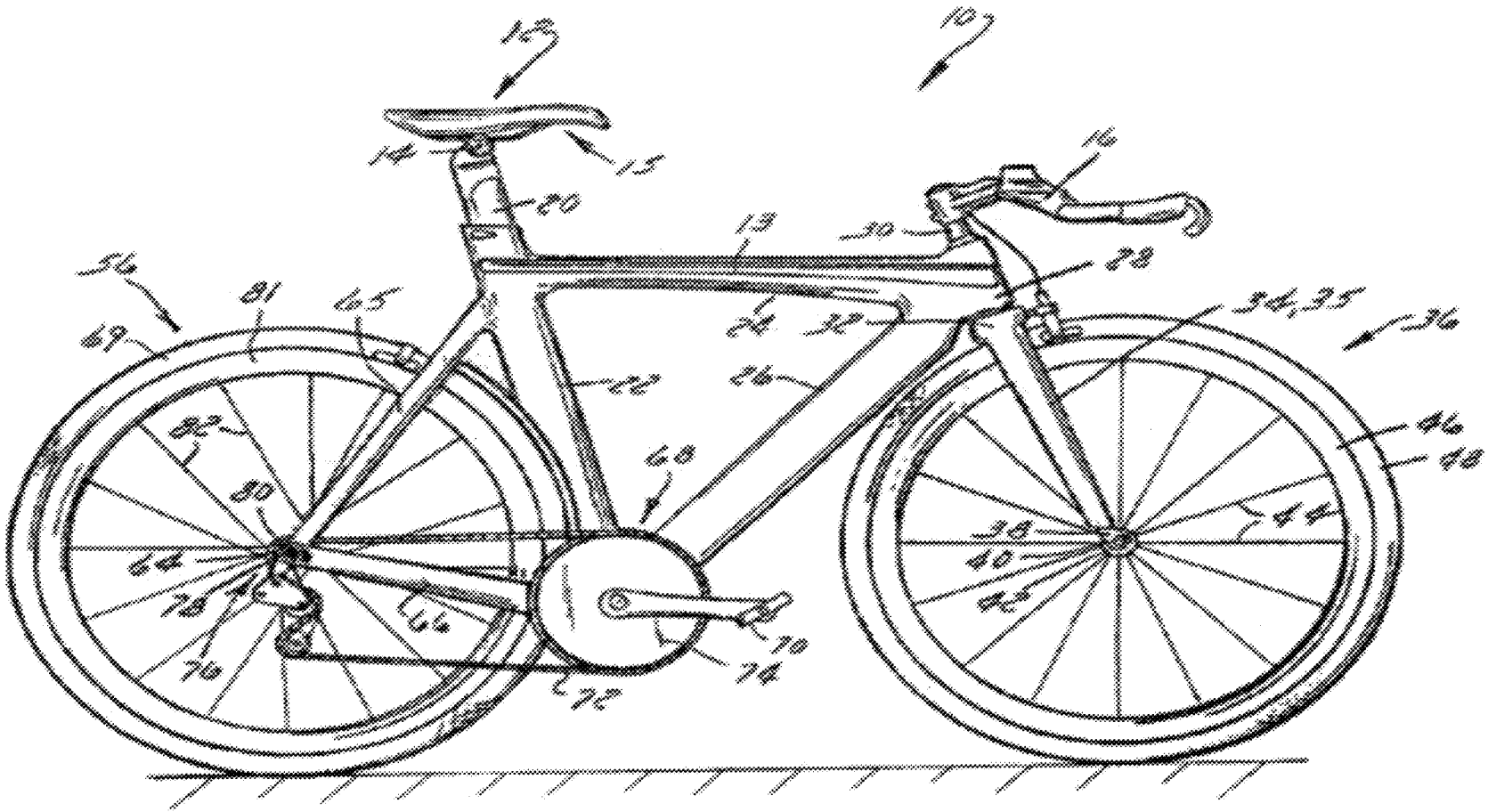
FIG. 1 shows a bicycle (after assembly) that can be shipped in the proposed packaging system in accordance with the embodiments described herein.

FIG. 1 shows a bicycle 10 (after assembly) that can be shipped in the proposed packaging system in accordance with the embodiments described herein. The bicycle 10 includes a frame 13 to which a seat assembly 12 and handlebars 16 are attached. A seat clamp 14 is engaged with an underside 15 of seat assembly 12 and cooperates with a seat post 20 that slidably engages a seat tube 22 of frame 13. A top tube 24 and a down tube 26 extend forwardly from seat tube 22 to a head tube 28 of frame 13.

Handlebars 16 are connected to a steerer tube 30 that passes through head tube 28 and engages a fork crown 32. A pair of forks 34, 35 extend from generally opposite ends of fork crown 32 and are constructed to support a front wheel assembly 36 at an end thereof or fork tip 38. Fork tips 38 engage generally opposite sides of an axle 40 that is constructed to engage a hub 42 of front wheel assembly 36. A number of spokes 44 extend from hub 42 to a rim 46 of front wheel assembly 36. A tire 48 is engaged with rim 46 such that rotation of tire 48, relative to forks 34, rotates rim 46 and hub 42.

A rear wheel assembly 56 is positioned generally concentrically about a rear axle 64. A seat stay 65 and a chain stay 66 offset rear axle 64 from a crankset 68. Crankset 68 includes pedals 70 that are operationally connected to a flexible drive such as a chain 72 via a chain ring or sprocket 74. Rotation of chain 72 communicates a drive force to a rear section 76 of bicycle 10 having a gear cluster 78 positioned thereat. Gear cluster 78 is generally concentrically orientated with respect to rear axle 64 and includes a number of variable diameter gears.

Gear cluster 78 is operationally connected to a hub 80 associated with a rear tire 69 of rear wheel assembly 56. A number of spokes 82 extend radially between hub 80 and a rim 81 that supports tire 69 of rear wheel assembly 56. As is commonly understood, rider operation of pedals 70 drives chain 72 thereby driving rear tire 69 which in turn propels bicycle 10. The bicycle 10 can be provided in any of a road bicycle, mountain bicycle, off-road bicycle, trail bicycle, etc. configuration.

Figure 2A:
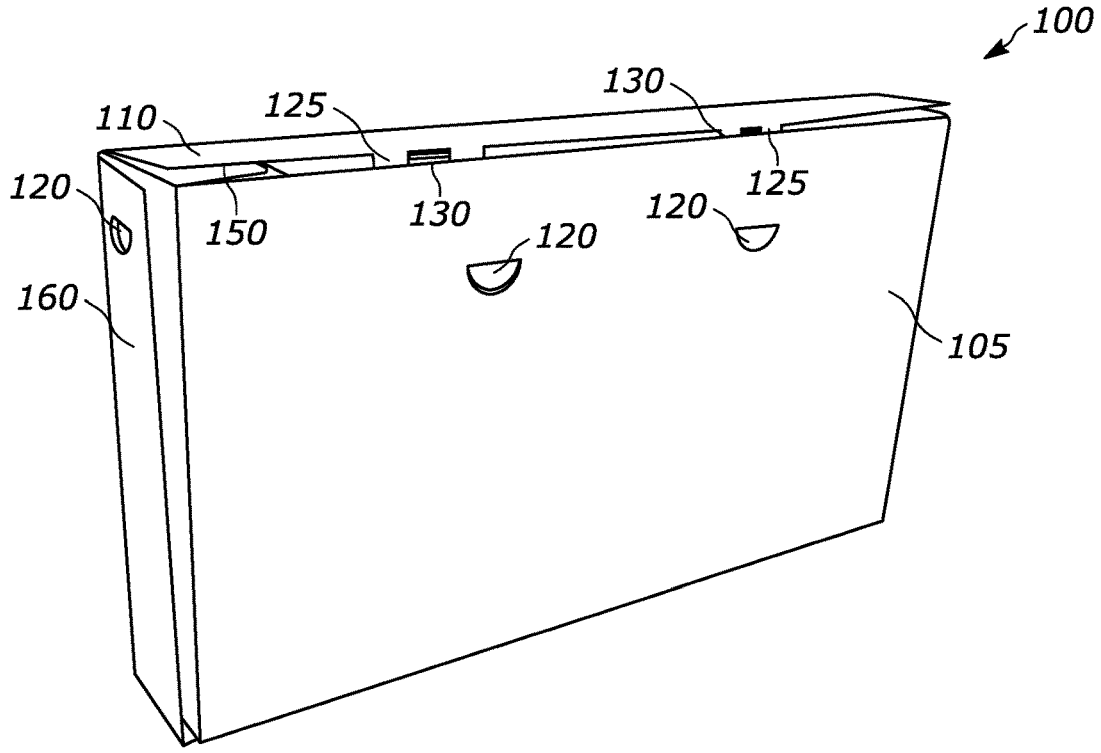
FIG. 2A is a front perspective view of a packaging system for a bicycle (in a closed configuration) in accordance with an illustrative embodiment.
Figure 2B:
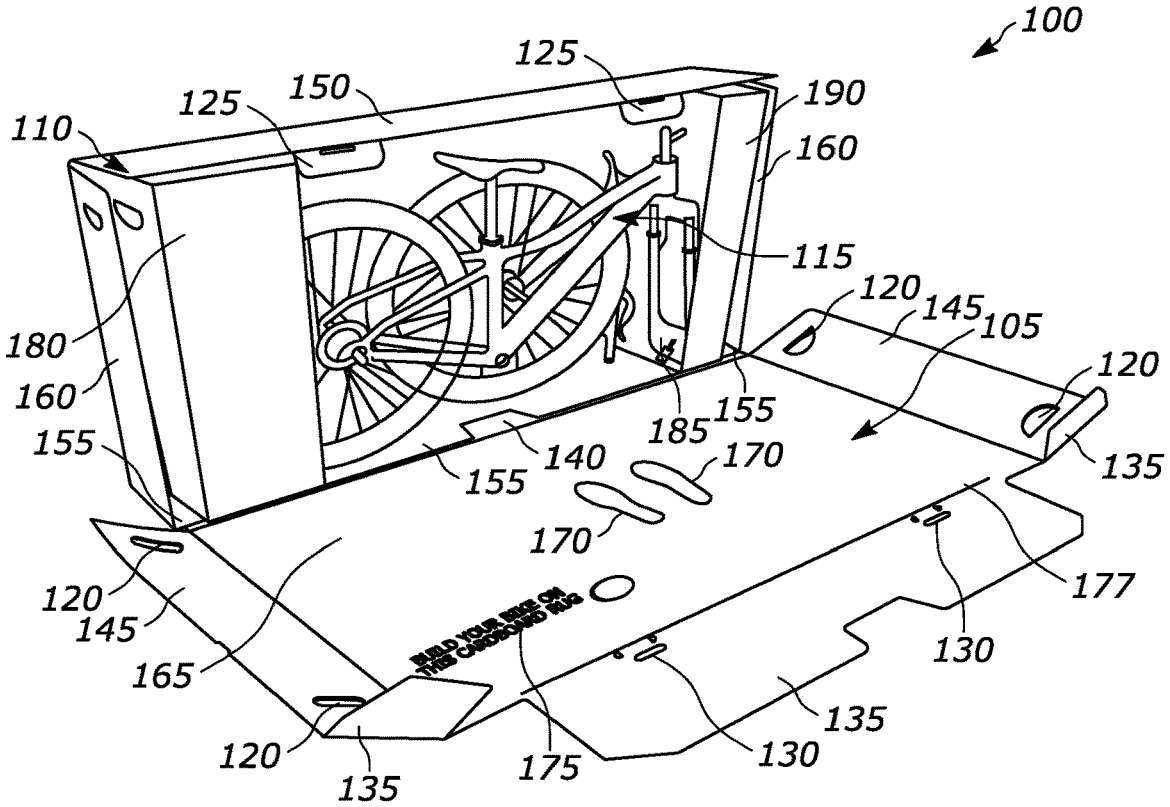
FIG. 2B is a front perspective view of the packaging system for a bicycle (in an open configuration) in accordance with an illustrative embodiment.

FIG. 2A is a front perspective view of a packaging system 100 for a bicycle (in a closed configuration) in accordance with an illustrative embodiment. FIG. 2B is a front perspective view of the packaging system 100 for a bicycle (in an open configuration) in accordance with an illustrative embodiment. In an illustrative embodiment, the packaging system 100 is formed from cardboard, although a different material can be used in alternative embodiments. Any components of the packaging system 100 can include a coating (e.g., wax) that helps protect the packaging system 100 from moisture and the environment.

The packaging system 100 includes a front panel 105 and a rear panel 110 that mate with one another to enclose and protect a bicycle 115 that is being shipped. In an illustrative embodiment, the front panel 105 and the rear panel 110 are individual components of the packaging system that are identical in size and shape. In an alternative embodiment, the front panel 105 and the rear panel 110 can be different from one another in size and/or shape. In another alternative embodiment, the front panel 105 and the rear panel 110 can be formed as a single continuous sheet of material (e.g., cardboard, etc.).

The packaging system 100 includes handles 120 that allow one or more users or delivery personnel to lift and move the system. In one embodiment, the packaging system 100 can include eight handles 120 (e.g., two on the front, two on the back, and two on each side). Alternatively, a different number of handles may be used and/or they may be positioned at different locations on the packaging system 100. As also shown, the rear panel 110 of the packaging system 100 includes tabs 125, each of which includes a slot that is designed to receive tabs 130 of the front panel 105. The interlocking tabs 125/130 secure the upper portion of the front panel 105 to the upper portion of the rear panel 110. Similarly, an identical locking tab system is positioned at the bottom rear of the packaging system 100 and used to secure the lower portion of the front panel 105 to the lower portion of the rear panel 110.

The front panel 105 includes top flaps 135, a bottom flap 140, and side flaps 145 that are positioned adjacent to a corresponding top flap 150, bottom flaps 155, and side flaps 160 of the rear panel 110 when the packaging system is in the closed configuration. As a result, the front panel 105 and the rear panel 110 are secured to one another without the use of staples or adhesives such as glue. As a precautionary measure during shipping, tape and/or straps/bands may be placed around the outside of the packaging system 100 to help ensure that the front panel 105 remains secured to the rear panel 110.

In the open configuration of FIG. 2B, the front panel 105 of the packaging system 100 folds down onto the floor (or ground) and provides a work surface 165 for the user to assemble his/her bicycle. Additionally, because the front panel 105 folds down, the user does not have to lift the bicycle 115 out from the top of the packaging system 100. Rather, once the front panel 105 is lowered to present the work surface 165, the bicycle 115 can simply be slid over onto the work surface 165 with minimal effort and lifting. The work surface 165 (i.e., the inner surface of the front panel 105, excluding flaps) includes an indicia 170 that directs the user where to stand when he/she removes the bicycle 115 from the rest of the packaging system 100. In the embodiment of FIG. 2B, the indicia 170 is a pair of footprints that directs the user where to place his/her feet. In alternative embodiments, a different type of indicia may be used, such as text, arrows or other symbols, etc. The work surface 165 also includes text 175 that identifies the purpose of the work surface 165 (i.e., as an area for the user to assemble his/her bicycle). Alternatively, instead of the text 175, symbols and/or imagery may be used to convey the purpose of the work surface 165 to the user. The work surface 165 further includes text 177 that provides assistance to the user, such as a customer support phone number, a uniform resource locator (URL) that links to an owner's manual for the bicycle 115, etc.

As shown in FIG. 2B, the rear wheel of the bicycle 115 is secured by a rear support 180. As discussed in more detail below, the rear support 180 also increases the structural integrity of the packaging system 100 and acts as a storage system for other items included in the packaging system such as an owner's manual, a tool kit, fasteners, pedals, etc. The front forks of the bicycle 115 are secured to a front fork mount 185, which is positioned within a front support 190 of the packaging system 100. The front support 190 also adds structural integrity to the packaging system 100. In an illustrative embodiment, a strap is used to secure the front fork mount 185 to a bottom wall of the front support 190. In one embodiment, the bottom wall of the front support 190 includes a pair of slots that aligns with another pair of slots formed in the front fork mount 185. A strap is run through each of the aligned slots and wrapped around the front fork mount 185 to secure the front fork mount 185 to the bottom wall.

In the embodiment of FIG. 2B, the bicycle 115 is in a partially disassembled state such that the packaging system 100 can be made small enough to ship via commercial carriers. Specifically, the front tire, steering wheel, cranks, and pedals are not mounted to the bicycle frame. In the depicted embodiment, the front tire and steering wheel are secured to the bicycle frame via straps and padding, and the cranks and pedals are stored in the rear support 180. In alternative embodiments, the components that are to be mounted by the user can be arranged differently within the packaging system 100. These components can be readily mounted to the frame by the user on the work surface 165. Any necessary tools can be included in a tool kit positioned in the rear support 180. Alternatively, the tool kit may be placed elsewhere in the packaging system 100.

Figure 3A:
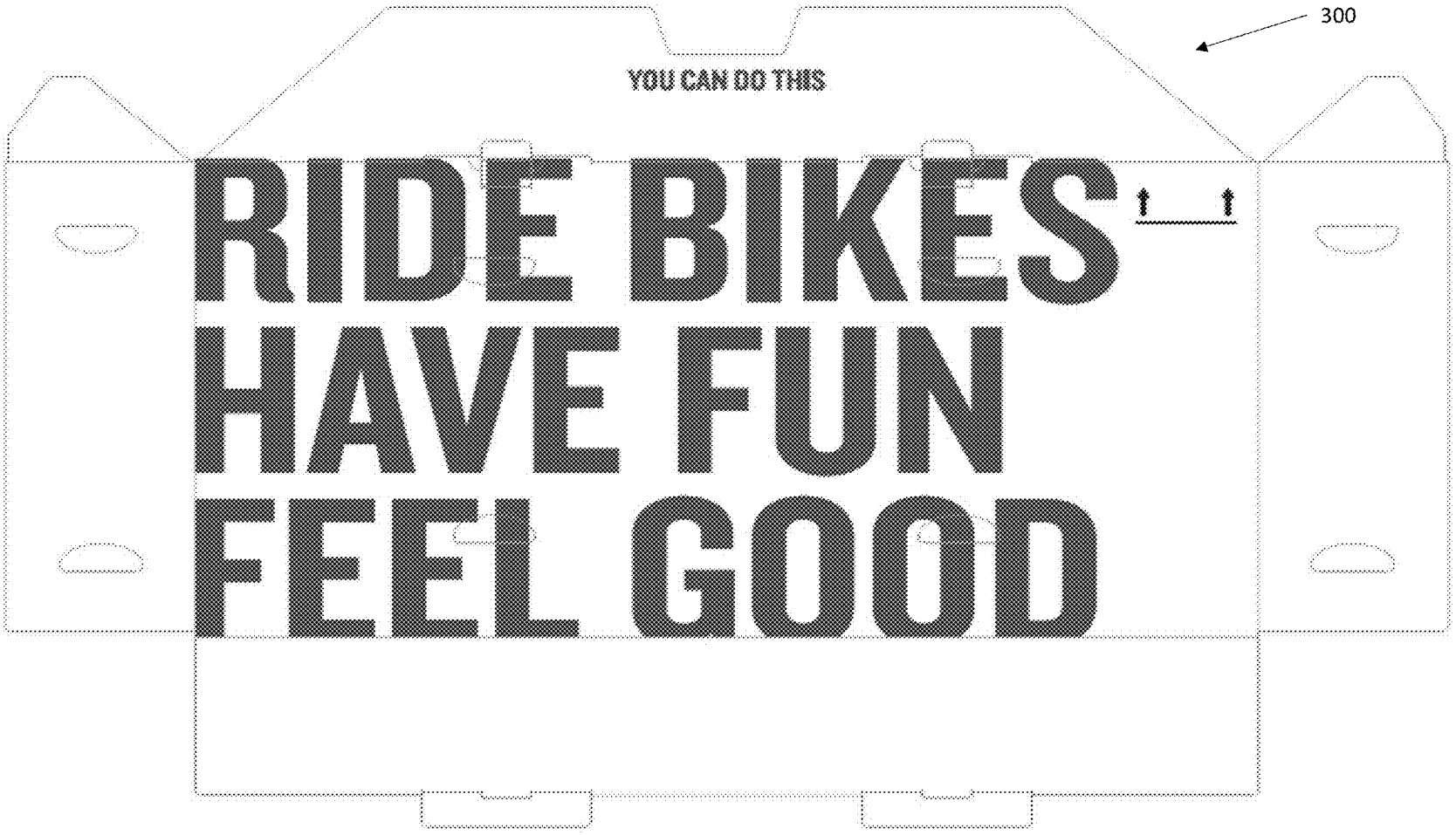
FIG. 3A depicts an exterior side of a front panel in accordance with an illustrative embodiment.
Figure 3B:
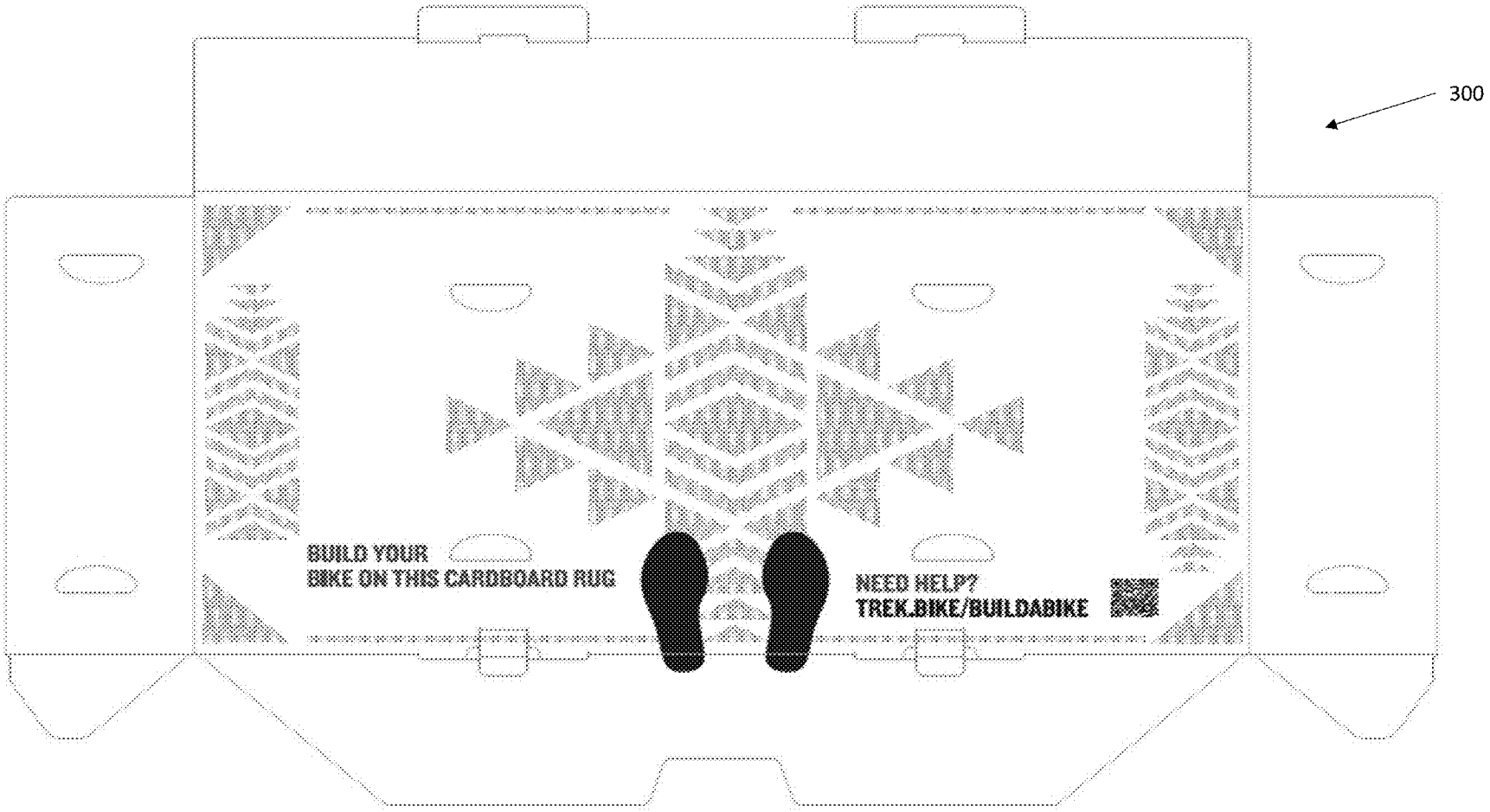
FIG. 3B depicts an interior side of the front panel in accordance with an illustrative embodiment.
Figure 3C:
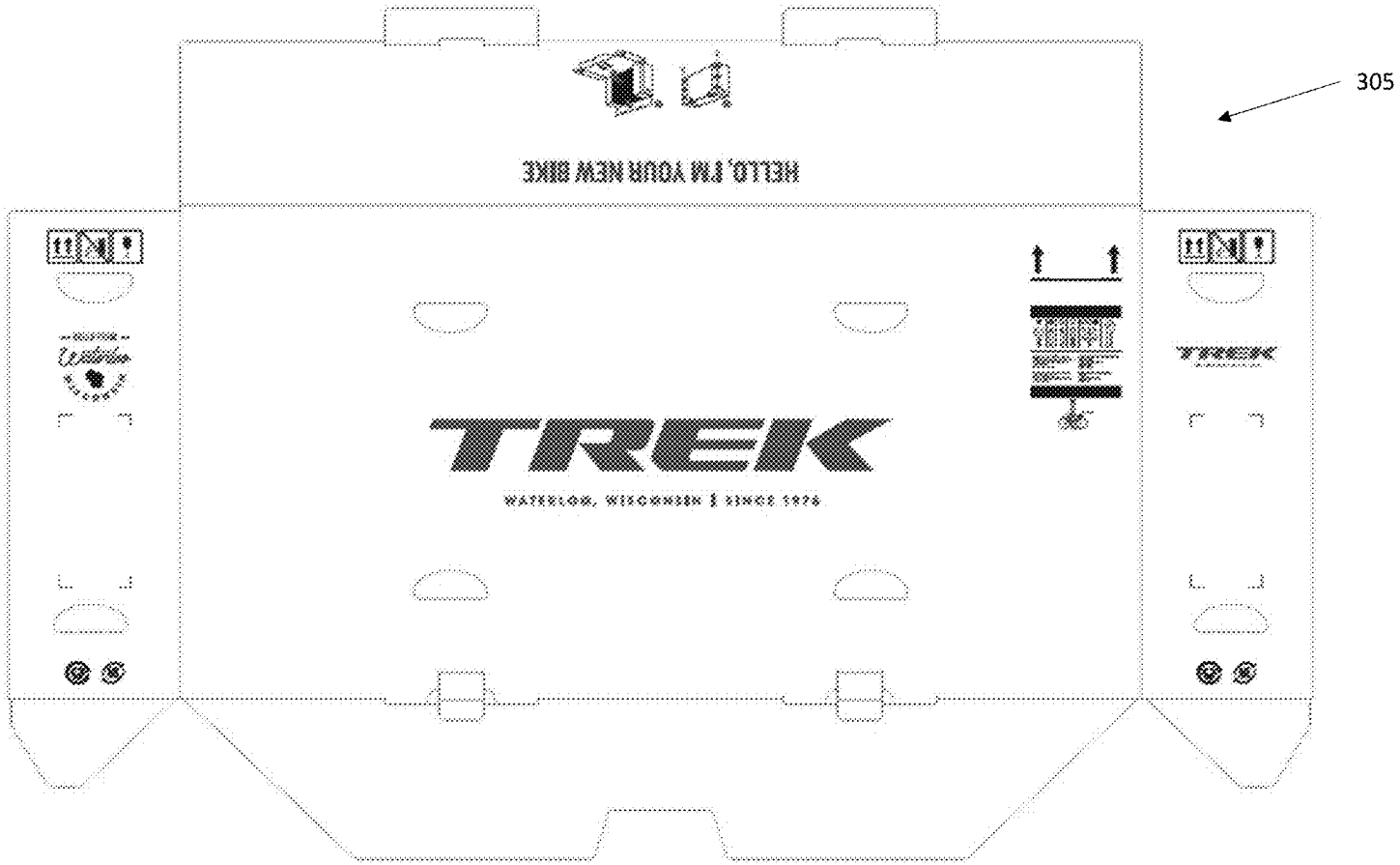
FIG. 3C depicts an exterior side of a rear panel in accordance with an illustrative embodiment.
Figure 3D:
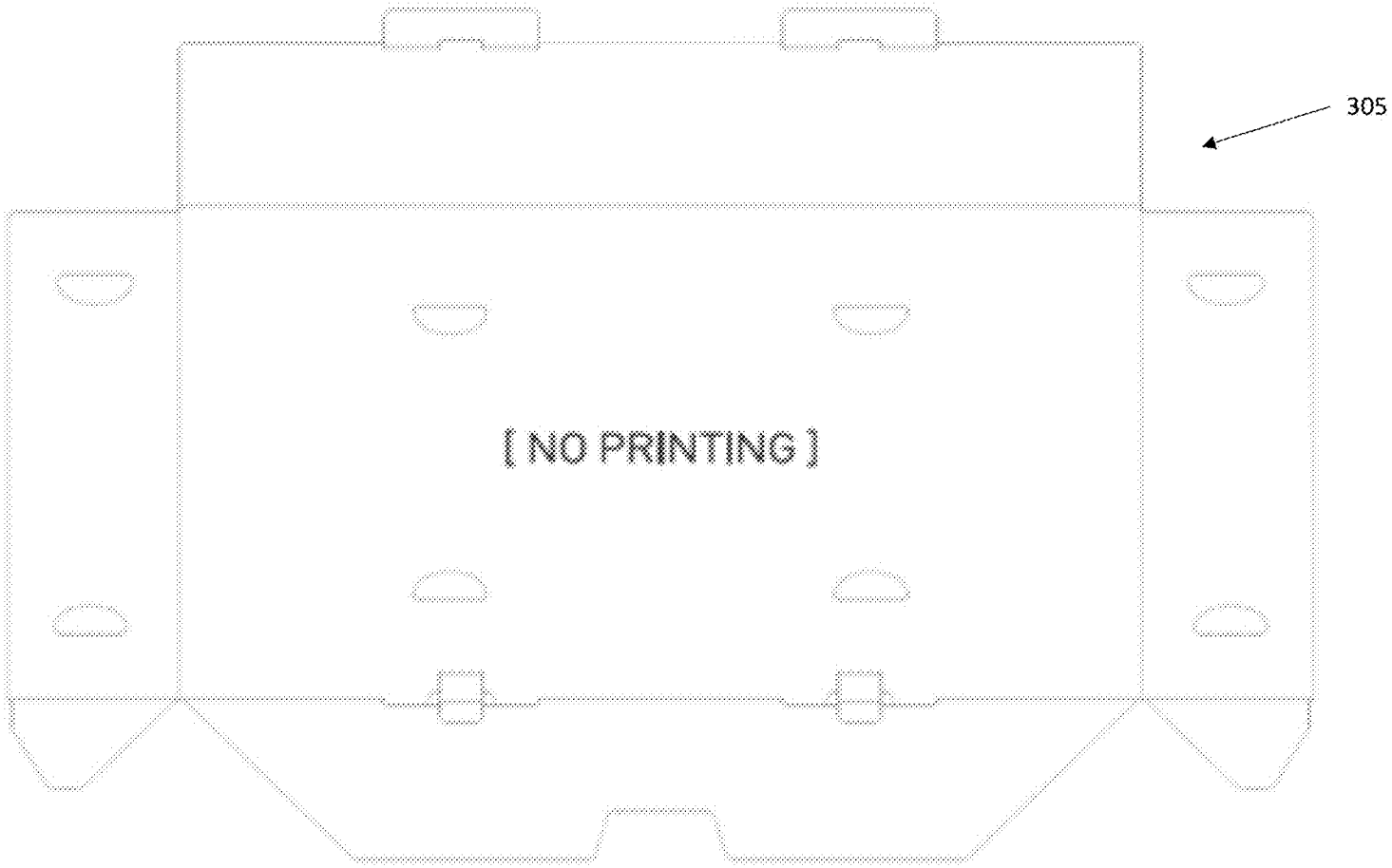
FIG. 3D depicts an interior side of the rear panel in accordance with an illustrative embodiment.

FIG. 3A depicts an exterior side of a front panel 300 in accordance with an illustrative embodiment. FIG. 3B depicts an interior side of the front panel 300 in accordance with an illustrative embodiment. FIG. 3C depicts an exterior side of a rear panel 305 in accordance with an illustrative embodiment. FIG. 3D depicts an interior side of the rear panel 305 in accordance with an illustrative embodiment. The depictions of FIGS. 3A-3D include fold lines to illustrate how each of the front and rear panels is folded to form the exterior shell of the packaging system.

Figure 4A:
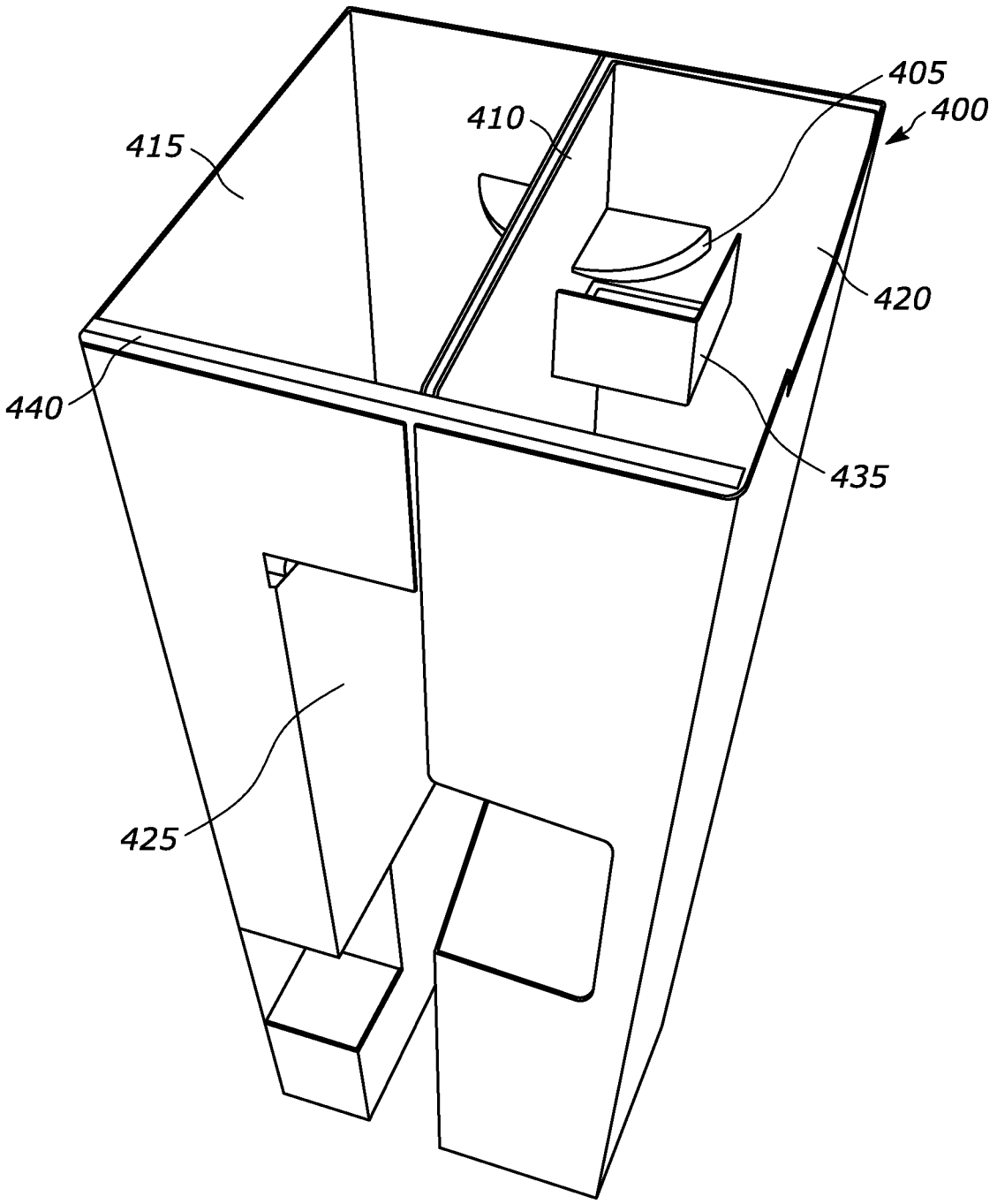
FIG. 4A is a perspective view of a rear support for the packaging system in accordance with an illustrative embodiment.
Figure 4B:
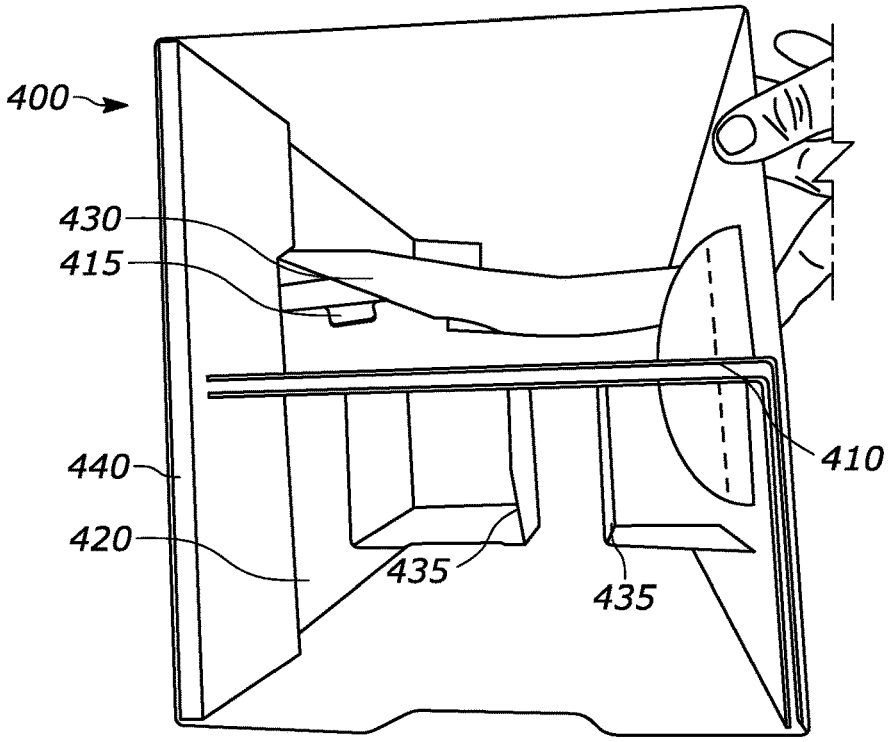
FIG. 4B is a plan view of the rear support in accordance with an illustrative embodiment.

FIG. 4A is a perspective view of a rear support 400 for the packaging system in accordance with an illustrative embodiment. FIG. 4B is a plan view of the rear support 400 in accordance with an illustrative embodiment. As shown, the rear support 400 includes a handle 405 than can be used to carry the rear support 400 and its components. The rear support 400 also includes a central divider 410 that separates a first side 415 of the rear support 400 from a second side 420 of the rear support 400. The rear support 400 further includes a tire receptacle 425, which is a cavity in the rear support 400 that is sized to receive at least a portion of a rear tire of a bicycle. Within the tire receptacle 425, one side of the tire is supported by the central divider 410 and the other side of the tire is supported by a tire support wall 430.

The rear support 400 also includes stops 435 formed on its interior that are used to facilitate placement of additional parcels/items within the rear support 400. For example, a tool kit box can rest on one or more of the stops 435 and be supported by them. The tool kit box (or other box/item) can also be held adjacent to an interior sidewall of the rear support 400 and/or held adjacent to the center divider 410 by one or more of the stops 435. In an illustrative embodiment, the stops 435 are formed through two parallel incisions made in the cardboard of the rear support, where the two parallel incisions extend through a corner of the rear support 400. The cardboard between the two incisions is then folded into an interior of the corner to form each of the stops 435.

Figure 4C:
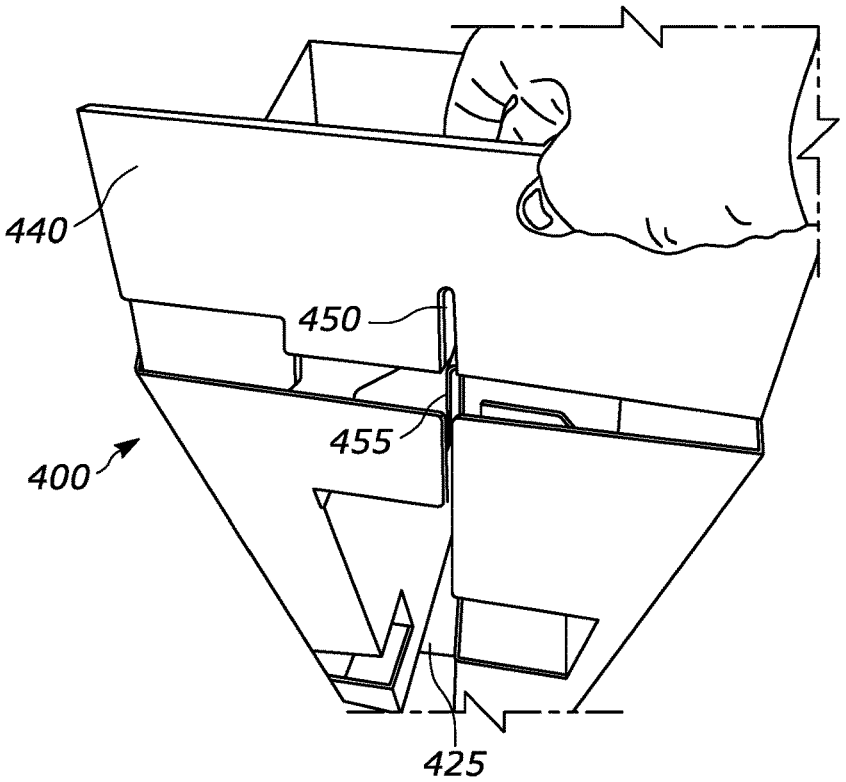
FIG. 4C depicts a tire wedge partially removed from the rear support in accordance with an illustrative embodiment.
Figure 4D:
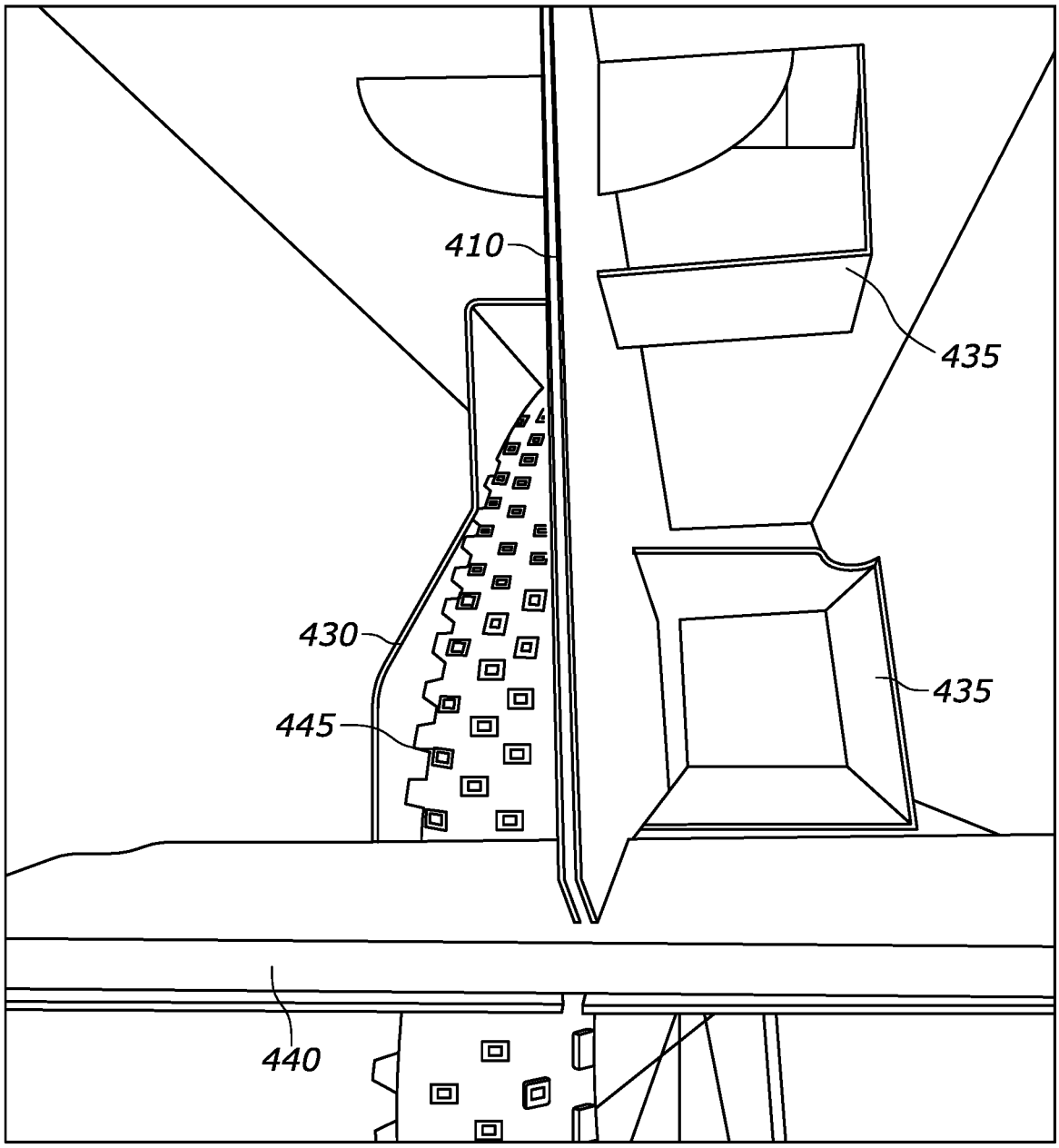
FIG. 4D is a close-up partial view of the rear support that depicts the tire wedge positioned to secure a rear tire of a bicycle in accordance with an illustrative embodiment.

The rear support 400 also includes a tire wedge 440, which is used to lock the rear tire in place within the tire receptacle 425. FIG. 4C depicts the tire wedge 440 partially removed from the rear support 400 in accordance with an illustrative embodiment. FIG. 4D is a close-up partial view of the rear support 400 that depicts the tire wedge 440 positioned to secure a rear tire 445 of a bicycle in accordance with an illustrative embodiment. The tire wedge includes a slot 450 that extends over and mates with the central divider 410 such that the tire wedge 440 is held in place. There is also a gap 455 between a front edge of the central divider 410 and an interior of the front wall of the rear support 400 to accommodate a body of the tire wedge 440. The gap 455 between the central divider 410 and the front wall of the rear support 400 extends downward a distance that is equal to the shortest distance between a base of the slot 450 and the top of the tire wedge 440. As such, the top of the tire wedge 440 does not extend beyond the top of the rear support 400 when installed, and the top lids of the packaging system can be closed such that they rest upon the top of the rear support 400. Additionally, the size of the tire wedge 440, the length of the slot 450, and/or the depth of the gap 455 can be varied to accommodate different sizes of bicycle tires. For example, a first tire wedge can be used to secure a large tire and a second tire wedge (that differs in size from the first tire wedge) can be used to secure a small tire.

As shown in FIG. 4D, the rear tire 445 is positioned between the central divider 410 and the tire support wall 430. The tire wedge 440 rests on top of the tire such that the cardboard of the tire wedge 440 contacts and interacts with the tire treads to keep the rear tire 445 held in place. When closed, the top flaps of the packaging system press down upon the tire wedge 440 and prevent it from lifting up off of the rear tire 445.

Figure 4F:
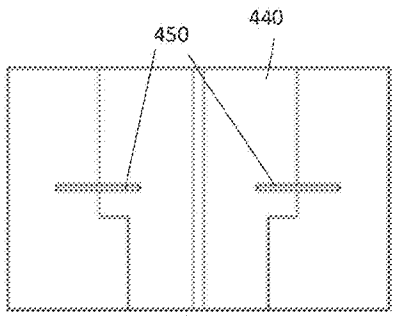
FIG. 4F depicts the tire wedge in a flattened out configuration in accordance with an illustrative embodiment.
Figure 4E:
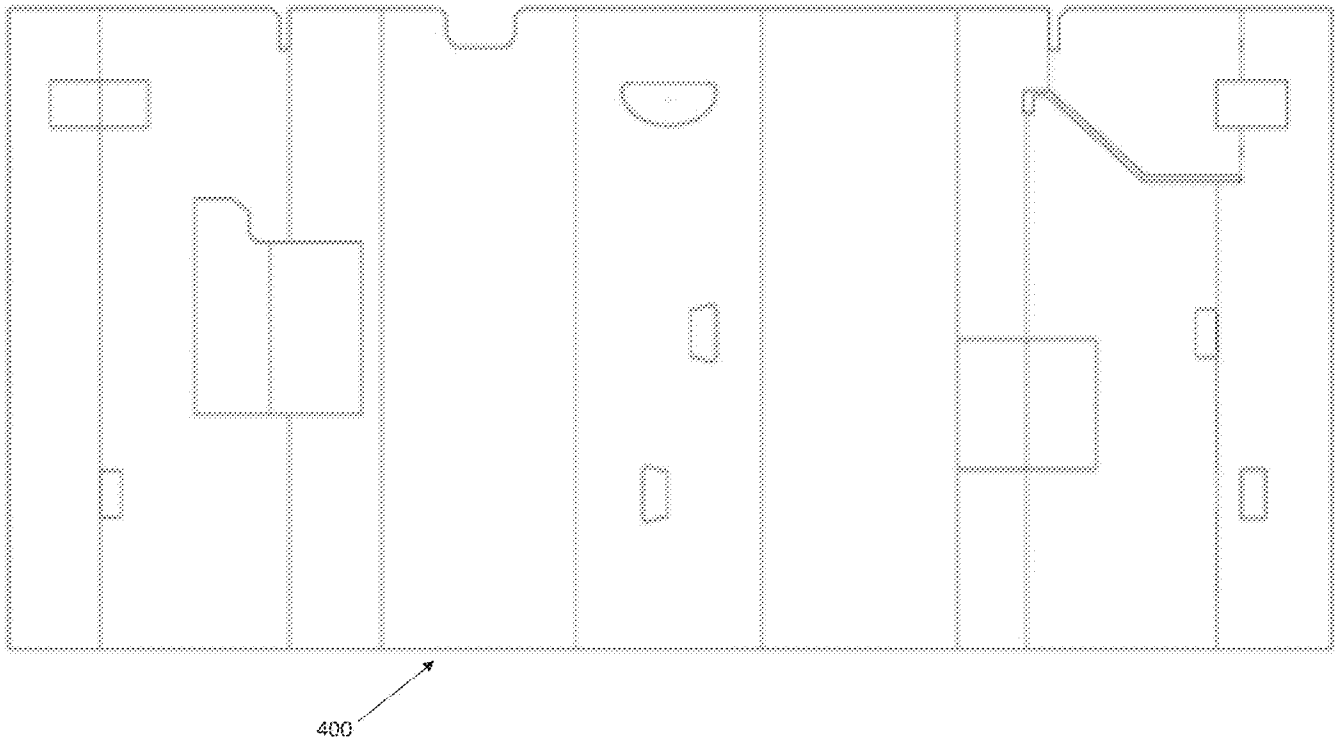
FIG. 4E depicts the rear support in a flattened out configuration in accordance with an illustrative embodiment.
Figure 4G:
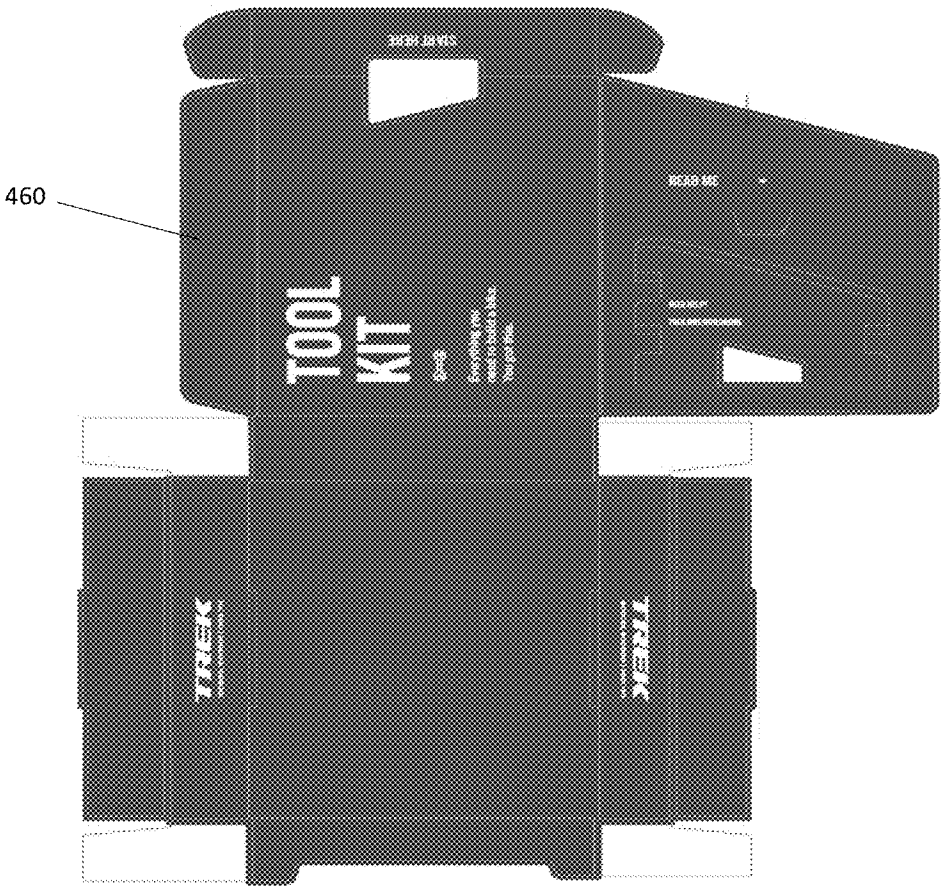
FIG. 4G depicts a flattened version of a tool kit box in accordance with an illustrative embodiment.

FIG. 4E depicts the rear support 400 in a flattened out configuration in accordance with an illustrative embodiment. FIG. 4F depicts the tire wedge 440 in a flattened out configuration in accordance with an illustrative embodiment. The various folds, openings, and incisions of the rear support 400 and tire wedge 440 are represented by lines on the depictions presented in FIGS. 4E and 4F. FIG. 4G depicts a flattened version of a tool kit box 460 in accordance with an illustrative embodiment. The tool kit box 460 can be used to hold tools, instructions, etc. that assist the purchaser with assembly of the bicycle. In an illustrative embodiment, the stops 435 included in the interior of the (assembled) rear support can be used to securely hold the (assembled) tool kit box 460 and its contents within the rear support 400. Alternatively, the tool kit box 460 may be placed elsewhere in the system, such as in the front support.

Figure 5A:
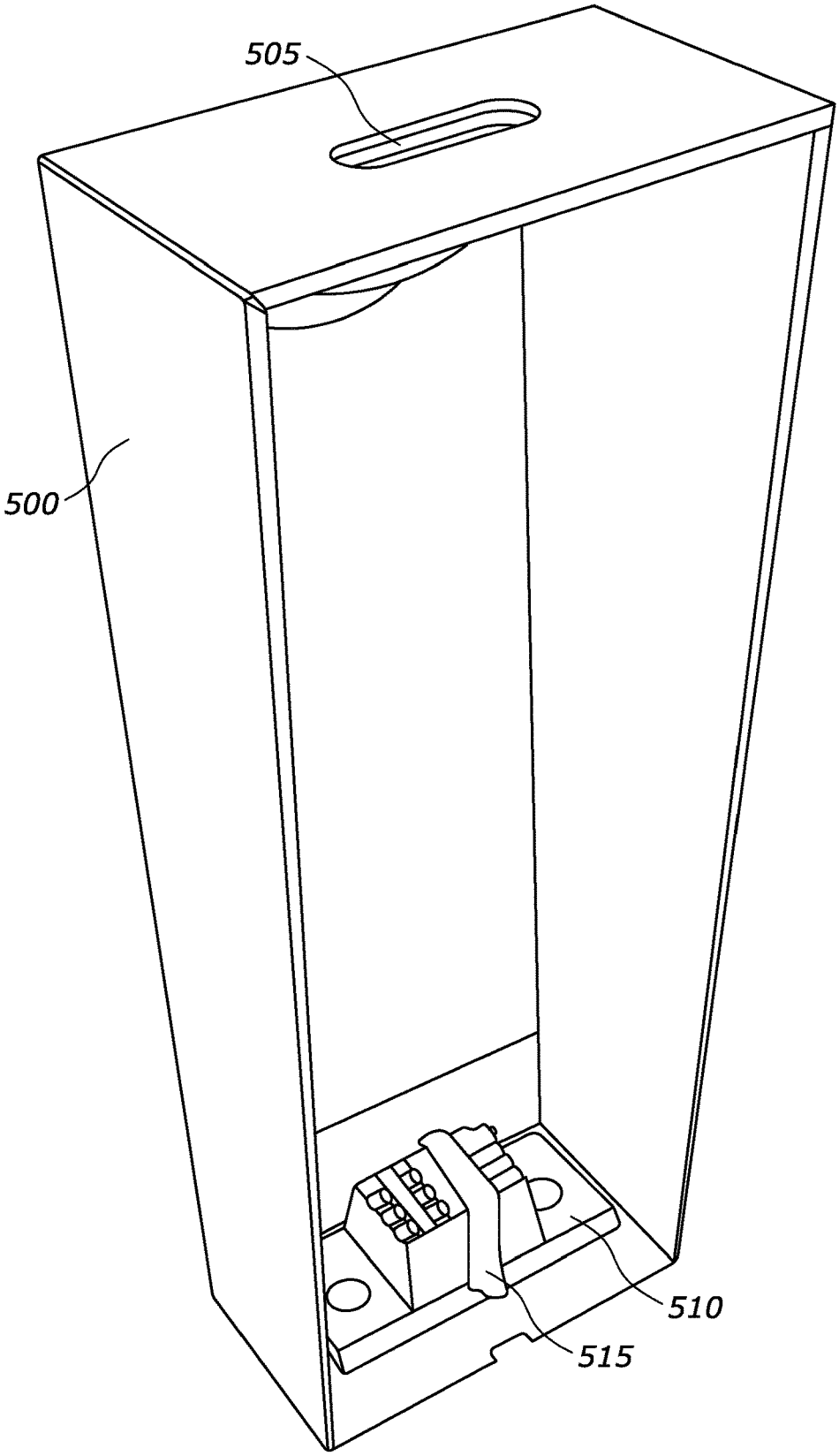
FIG. 5A depicts a front support in accordance with an illustrative embodiment.
Figure 5B:
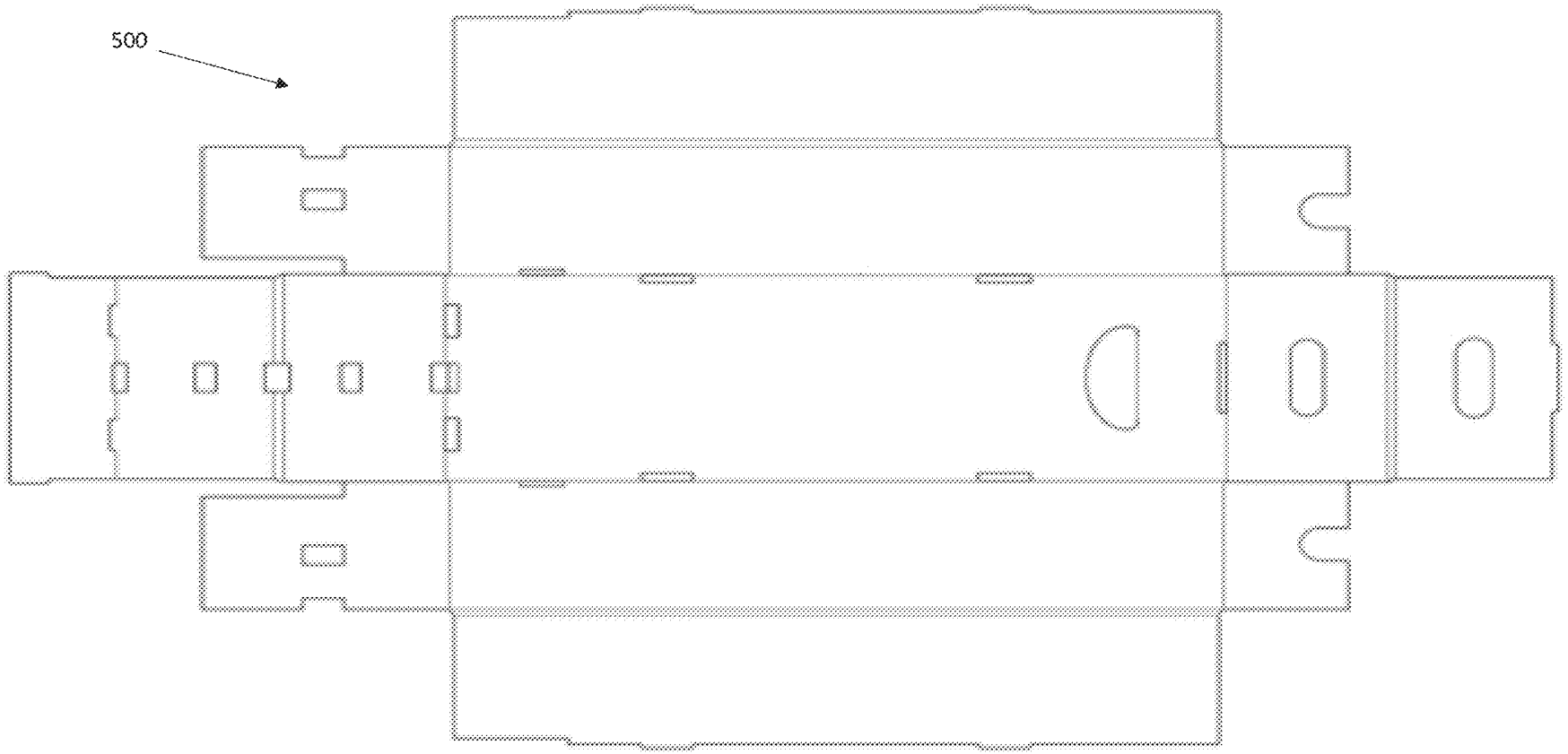
FIG. 5B depicts the front support in a flattened out configuration in accordance with an illustrative embodiment.

FIG. 5A depicts a front support 500 in accordance with an illustrative embodiment. The front support 500 is positioned within the packaging system at an end opposite of the rear support. The front support 500 provides added structural integrity to the system, and is also used to secure the front forks of the bicycle frame to the system. The front support 500 includes a handle 505 so that it can easily be carried and moved by the user. Also, a front fork mount 510 is mounted to a bottom of the front support 500. The front fork mount 510 is secured via a strap 515 that runs through openings in the bottom side (or floor) of the front support 500. In one embodiment, the openings in the bottom side of the front support 500 can be aligned with openings in the front fork mount 510 such that the strap 515, which can be a Velcro® strap, can also run through openings in the front fork mount 510 to prevent movement thereof when the strap 515 is secured. FIG. 5B depicts the front support 500 in a flattened out configuration in accordance with an illustrative embodiment.

Figure 5D:
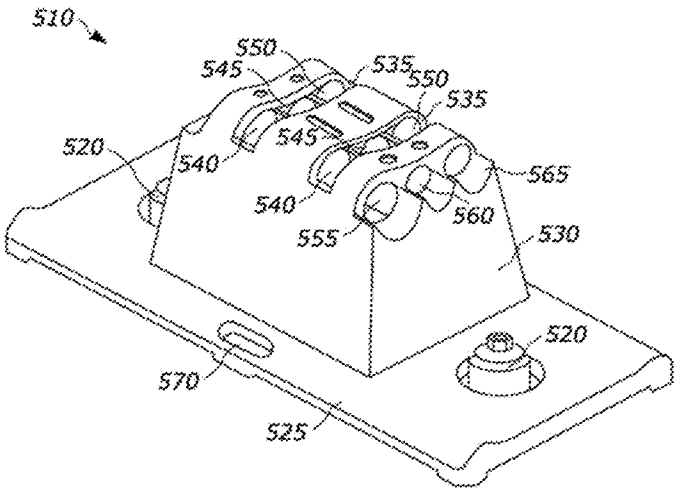
FIG. 5D is a perspective view of the front fork mount with fastener plugs in accordance with an illustrative embodiment.
Figure 5E:
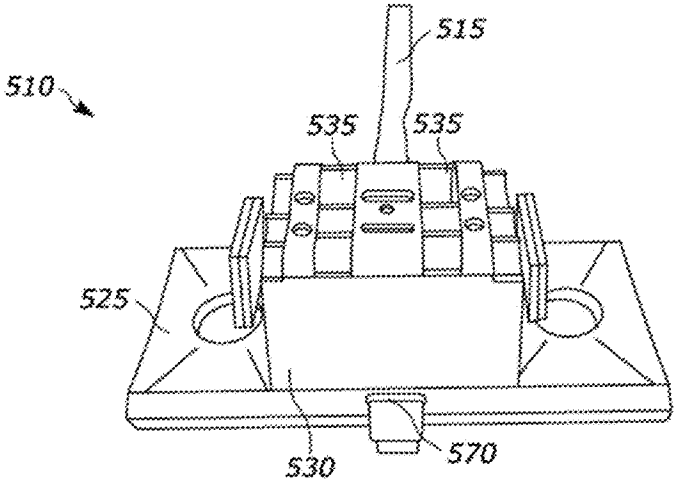
FIG. 5E depicts the front fork mount with the fastener plugs removed in accordance with an illustrative embodiment.
Figure 5C:
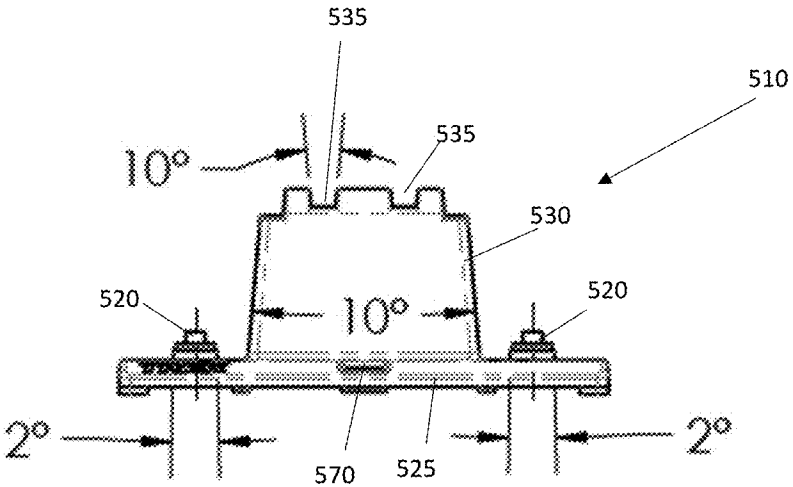
FIG. 5C is a front elevation view of the front fork mount in accordance with an illustrative embodiment.
Figure 5D:
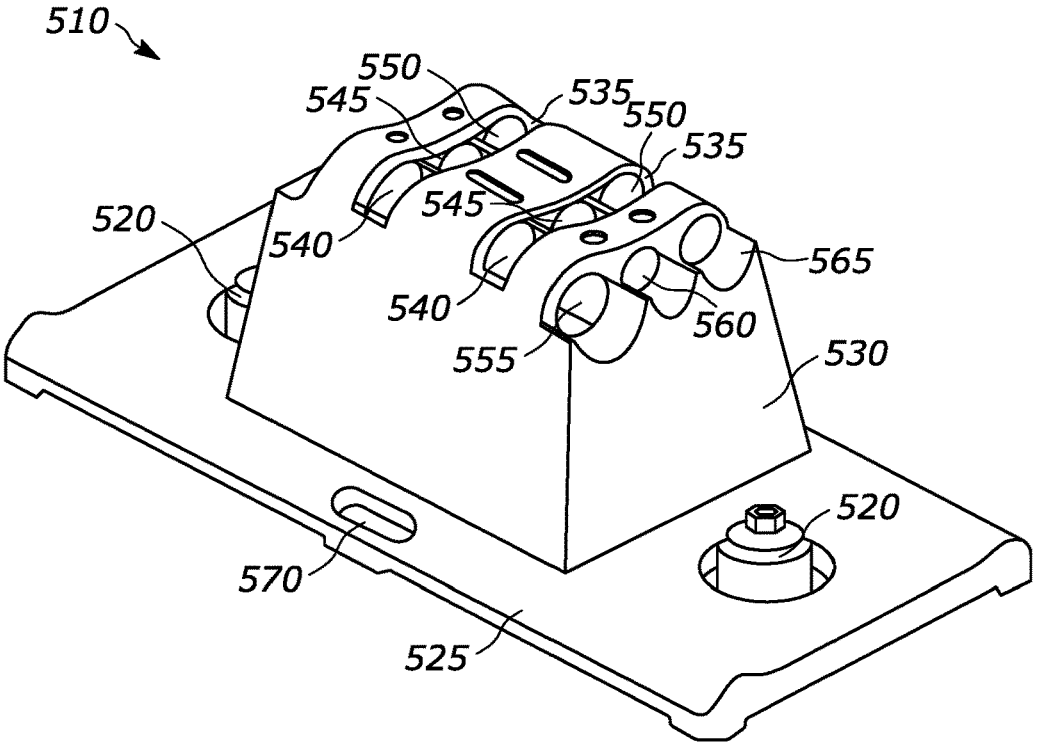
Figure 5E:
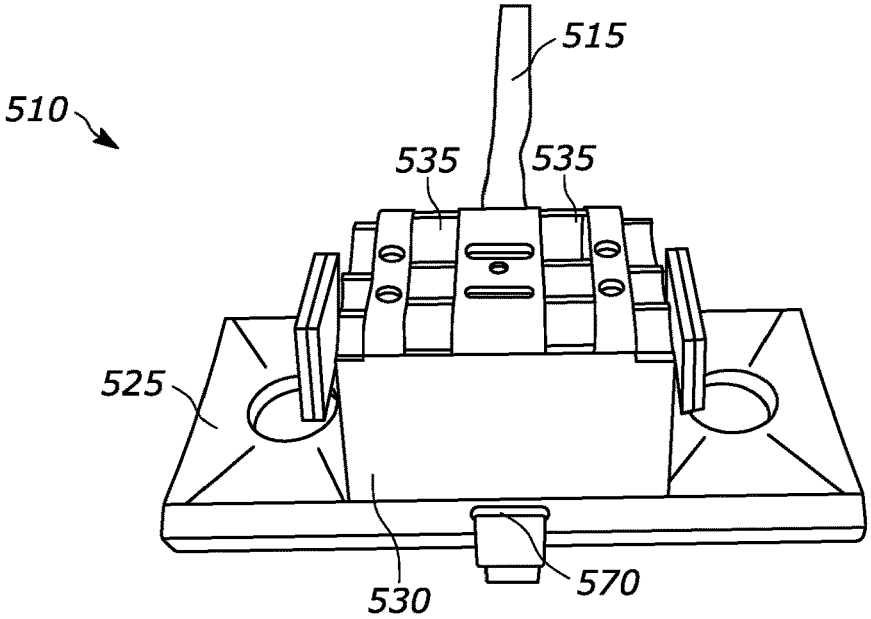

FIG. 5C is a front elevation view of the front fork mount 510 in accordance with an illustrative embodiment. FIG. 5D is a perspective view of the front fork mount 510 with fastener plugs 520 in accordance with an illustrative embodiment. FIG. 5E depicts the front fork mount 510 with the fastener plugs 520 removed in accordance with an illustrative embodiment. As shown in FIG. 5A, the front fork mount 510 includes a base 525 and a pedestal 530 that extends upward from the base 525. As shown, the walls of the pedestal 530 taper inward at an angle (e.g., 10 degrees) such that a bottom of the pedestal 530 is wider than the top of the pedestal 530. Alternatively a different angle may be used, such as 0 degrees, 20 degrees, etc. The pedestal 530 includes grooves 535 that are sized to receive a portion of the front forks of a bicycle. As shown, walls of the grooves 535 can extend upward at an angle (e.g., 10 degrees) relative to the top of the pedestal 530. Alternatively, a different angle may be used, such as 0 degrees, 20 degrees, etc.

In an illustrative embodiment, the front fork mount 510 is formed via molding. Incorporated into the mold are the fastener plugs 520, which are formed in openings in the base 525 and which are designed to be easily removed from the rest of the molded front fork mount 510. For example, readily breakable strands of plastic can hold the fastener plugs 520 in place on the base 525 of the molded front fork mount 510 until they are removed for use in securing the front forks. Specifically, once removed from the molded front fork mount 510, the fastener plugs 520 are used to secure the front forks to the pedestal 530 of the front fork mount 510, as described in more detail below. In an alternative embodiment, the front fork mount 510 may be made using a process other than molding.

In one embodiment, sidewalls of the fastener plugs 520 are tapered at an angle (e.g., 2 degrees) such that they can be mounted from the side of the pedestal 530 into one of a series of openings 555, 560, 565 to secure the forks. Alternatively, a different angle (or no angle) may be used. In an illustrative embodiment, each of the grooves 535 has three receptacles 540, 545, and 550 of varying size to accommodate different sizes of bicycle forks. Additionally, each side of the pedestal 530 includes the series of openings 555, 560, and 565 that extend into the respective receptacles 540, 545, and 550. In another illustrative embodiment, each of the openings 555, 560, and 565 has a different size and is designed to receive a different size of fastener plug 520. In one implementation, only the opening 555 may be configured to receive the fastener plug 520, and the other openings 560 and 565 can be designed to secure the bicycle forks via friction.

As an example, a first size of fastener plug 520 is designed to fit in the opening 555 to secure a first size of bicycle fork (e.g., small) in the receptacles 540, a second size of fastener plug is designed to fit in the opening 560 to secure a second size of bicycle fork (e.g., medium) in the receptacles 545, and a third size of fastener plug is designed to fit in the opening 565 to secure a third size of bicycle fork (e.g., large) in the receptacles 550. Thus, the front fork mount 510 is designed to accommodate a wide range of bicycles. In alternative embodiments, fewer or additional openings and receptacles may be included in the front fork mount 510. The front fork mount 510 also includes a pair of slots 570 that are configured to receive the strap 515 that secures the front fork mount 510 to the floor of the front support 500. In an alternative embodiment, the slots 570 may not be included.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more".

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A packaging system for a bicycle, comprising:

a rear panel;

a front panel that mates with the rear panel to form an enclosure, wherein the front panel partially detaches from the rear panel to lay flat on a ground surface that supports the packaging system such that at least a portion of an interior side of the front panel forms a work surface that covers the ground surface;

a rear insert positioned within the enclosure, wherein the rear insert includes a tire receptacle configured to receive a rear tire of the bicycle;

a tire wedge that mounts within the rear support to secure the rear tire of the bicycle, wherein the tire wedge includes a slot that mates with a central divider of the rear insert; and a front insert positioned within the enclosure opposite of the rear insert, wherein the front insert includes a front fork mount attached thereto, and wherein the front fork mount is configured to secure front forks of the bicycle.

2. The packaging system of claim 1, wherein the rear panel is identical in shape and size to the front panel.

3. The packaging system of claim 1, wherein the work surface includes indicia that direct a user where to stand to remove the bicycle from the enclosure.

4. The packaging system of claim 3, wherein the indicia comprise a pair of footprints.

5. The packaging system of claim 1, wherein the work surface includes text that specifies a purpose of the work surface.

6. The packaging system of claim 1, wherein the rear support includes a central divider, and wherein the central divider forms a first sidewall of the tire receptacle.

7. The packaging system of claim 6, further comprising a tire support wall on an interior of the rear support, wherein the tire support wall forms a second sidewall of the tire receptacle.

8. The packaging system of claim 1, wherein an interior of the rear support includes a plurality of stops, and wherein one or more of the plurality of stops is used to support a tool kit.

9. The packaging system of claim 1, where a portion of the tire wedge that does not include the slot is positioned in a partial gap between the central divider and an interior of a front wall of the rear insert.

10. The packaging system of claim 1, wherein the rear support is configured to accommodate a plurality of sizes of tire wedges, and wherein the plurality of sizes of tire wedges are designed to secure a corresponding plurality of sizes of rear tires.

11. The packaging system of claim 1, wherein a bottom edge of the tire wedge is configured to rest upon and interact with treads of the rear tire to hold the rear tire in place.

12. The packaging system of claim 1, wherein a bottom wall of the front support includes openings, and further comprising a strap that runs through the openings to secure the front fork mount to the bottom wall.

13. The packaging system of claim 1, wherein the front fork mount includes a pair of grooves that are designed to receive the front forks of the bicycle.

14. The packaging system of claim 13, wherein each groove in the pair of grooves includes a plurality of receptacles.

15. The packaging system of claim 14, wherein the plurality of receptacles are of varying sizes to accommodate varying sizes of the front forks.

16. The packaging system of claim 14, further comprising a plurality of openings that correspond to the plurality of receptacles.

17. The packaging system of claim 16, wherein each of the plurality of openings is designed to receive a fastener plug that secures the front forks of the bicycle to the front fork mount.

18. The packaging system of claim 17, wherein each of the plurality of openings has a different size and is configured to accommodate a different fastener plug.

* * * * *